United States Patent [19]

Slack

[11] 4,138,203

[45] Feb. 6, 1979

[54] SWASH PLATE COMPRESSOR

[76] Inventor: Don S. Slack, 48 Overlook Dr., Bolinas, Calif. 94924

[21] Appl. No.: 798,370

[22] Filed: May 19, 1977

[51] Int. Cl.[2] ..... F04B 1/12; F04B 27/08

[52] U.S. Cl. ..... 417/269

[58] Field of Search ..... 417/269–272, 417/222; 74/60; 91/499, 505

[56] References Cited

U.S. PATENT DOCUMENTS

| | | | |
|---|---|---|---|
| 1,389,873 | 9/1921 | Hult | 123/43 A |
| 2,671,606 | 3/1954 | Ricardo | 74/60 X |
| 2,968,961 | 1/1961 | McGregor | 417/271 X |
| 2,991,723 | 7/1961 | Zubaty | 417/269 |
| 3,018,737 | 1/1962 | Cook et al. | 417/269 X |
| 3,045,604 | 7/1962 | Hahn | 91/507 X |
| 3,062,020 | 11/1962 | Heidorn | 417/222 X |
| 3,152,555 | 10/1964 | Pauly | 417/270 |
| 3,398,699 | 8/1968 | Stark | 74/60 X |
| 3,636,779 | 1/1972 | Lappin | 74/60 X |
| 4,022,167 | 5/1977 | Kristiansen | 123/43 AA |
| 4,023,542 | 5/1977 | Ango | 123/43 AA |
| 4,037,993 | 7/1977 | Roberts | 417/222 |
| 4,061,443 | 12/1977 | Black et al. | 417/269 X |

FOREIGN PATENT DOCUMENTS

| | | | |
|---|---|---|---|
| 2307983 | 11/1976 | France | 417/269 |
| 781635 | 8/1957 | United Kingdom | 417/269 |
| 492678 | 11/1972 | U.S.S.R. | 417/269 |

*Primary Examiner*—John J. Vrablik
*Assistant Examiner*—Edward Look
*Attorney, Agent, or Firm*—Warren, Chickering & Grunewald

[57] ABSTRACT

A compressor or pump or motor-type structure having a housing with a bank of cylinders and a shaft journalled for rotation therein and fitted with a swash plate, sometimes referred to in the art as a wobble plate or cam or drive, which is connected to pistons mounted for reciprocation in the cylinders and which will effect such reciprocation upon rotation of the shaft. When used as a motor, entry of fluid under pressure into the cylinder heads will effect displacement of the pistons and driving of the shaft. Improved means is provided in the present structure for supporting the swash plate against rotational forces imposed thereon, in the mounting of the swash plate and in the connection between the swash plate and the pistons.

7 Claims, 6 Drawing Figures

SWASH PLATE COMPRESSOR

BACKGROUND OF THE INVENTION

The invention relates to compressors/motors having one or more cylinders, an axial drive shaft, a canted swash plate carried by the shaft and connected to pistons mounted in the cylinders, the rotary movement of the shaft being translated by the swash plate into a reciprocal displacement of the pistons. Devices of this general character are variously referred to in the art as an axial plunger wobble pump, U.S. Pat. No. 3,663,122; wobbler drive mechanism, U.S. Pat. No. 2,513,083; crankless motion mechanism, Patent No. 3,069,913. See also U.S. Pat. No. 2,398,486.

SUMMARY OF INVENTION

An object of the present invention is to provide a swash plate compressor of the character described which is particularly designed to pump air or gas without oil contamination, a problem which is virtually unsolvable in a conventional crankcase lubricated structure, where inevitable blowby of oil vapor will pass into the gas being compressed. The present structure is essentially free from lubrication requirements on the part of the operator between periodic maintenance.

Another object of the present invention is to provide a swash plate compressor of the character above having a compact, rigid structure of minimum size and weight and yet provide a relatively high capacity output while operating in a balanced, smooth condition with minimum vibration.

A further object of the present invention is to provide a compressor of the character above which will involve a fewer number of parts with reduced machining requirements, and which may be easily and rapidly assembled to provide a unit at minimum cost.

Yet another object of the present invention is to provide a swash plate compressor of the character described which is composed of durable parts affording easy disassembly when required for maintenance and affording a long, useful life.

Still another object of the present invention is to provide a structure of the character described which may be scaled up or down to readily provide units of different sizes and capacities.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

DETAILED DESCRIPTION OF INVENTION

Figure 1:
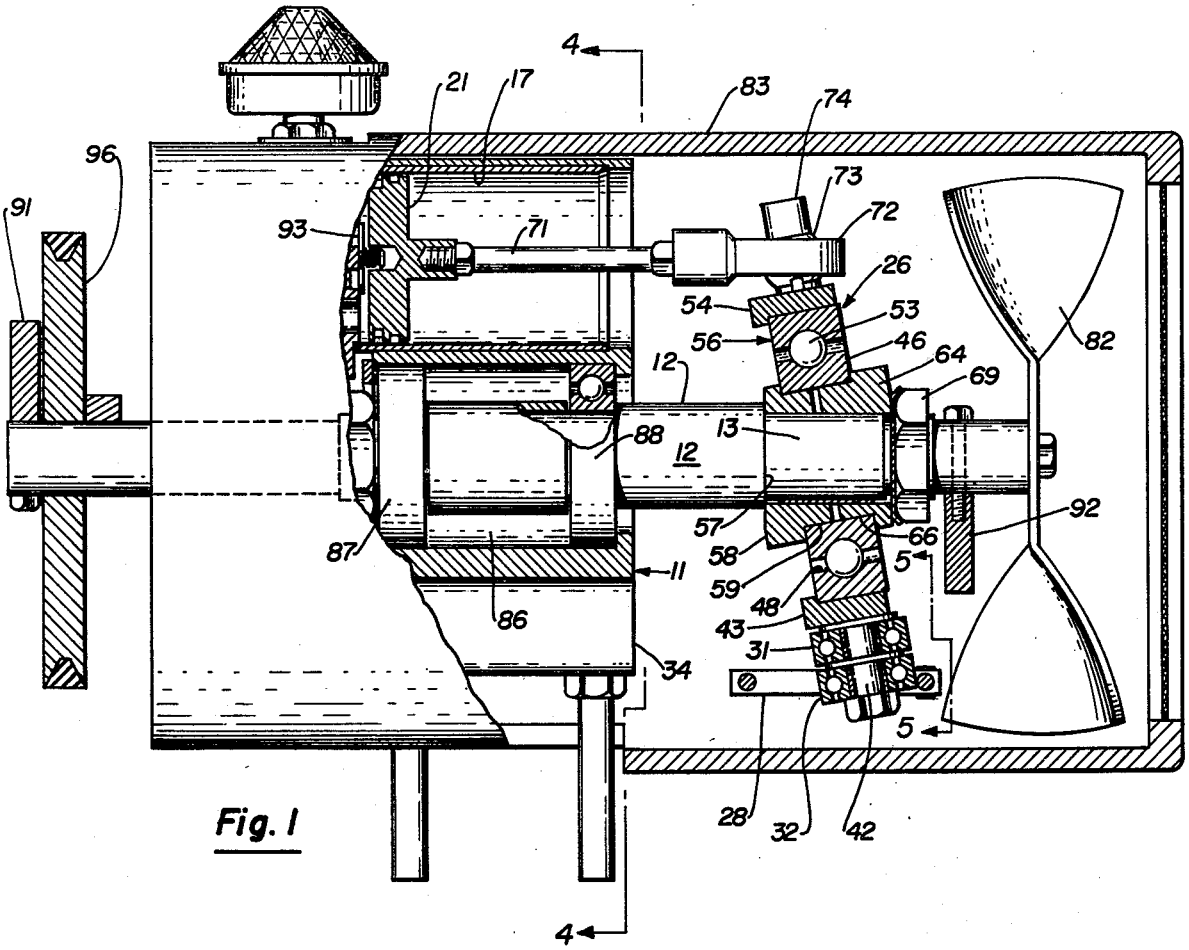
FIG. 1 is a side elevation, partially in section, of a swash plate compressor constructed in accordance with the present invention.
Figure 4:
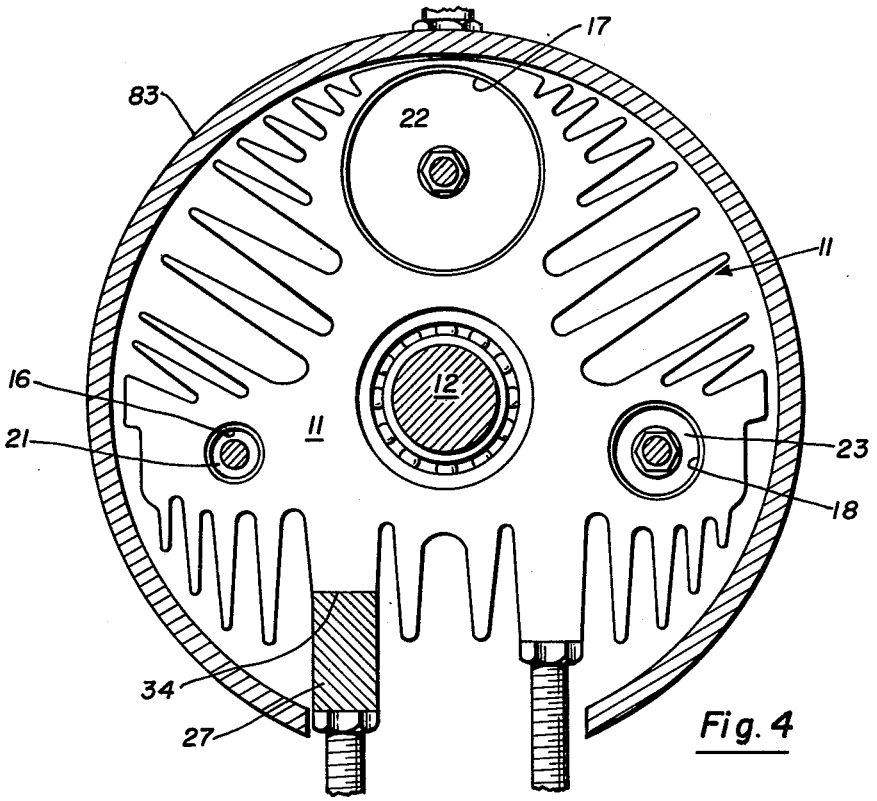
FIG. 4 is a cross-sectional view taken substantially on the plane of line 4—4 of FIG. 1.
Figure 5:
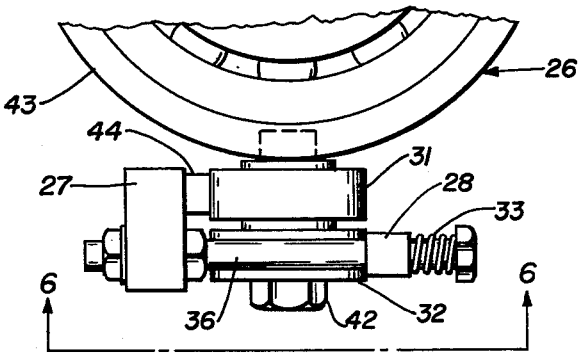
FIG. 5 is a fragmentary end elevation of a portion of the apparatus indicated at line 5—5 of FIG. 1.
Figure 6:
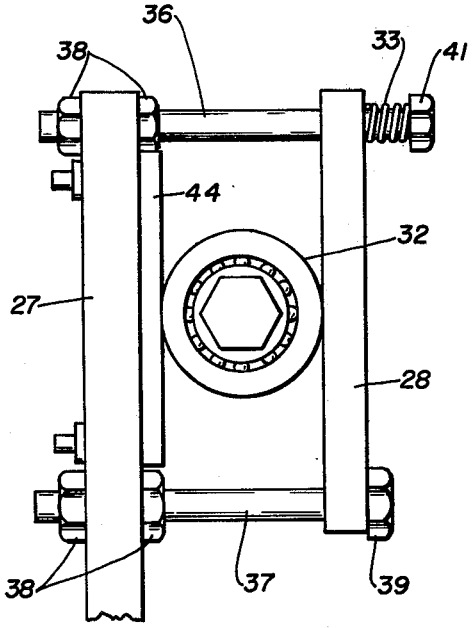
FIG. 6 is a bottom plan view of the structure of FIG. 5 taken as indicated by the line 6—6 of FIG. 5.

The compressor of the present invention comprises a housing 11 and a shaft 12 journalled for rotation therein and having an end 13 extending therefrom, housing 11 having a plurality of cylinders 16, 17 and 18 spaced radially from and extending parallel to shaft 12 and being circumferentially spaced about the shaft, see FIG. 4; pistons 21, 22 and 23 mounted for reciprocation in cylinders 16–18; a swash plate 26 journalled for rotation on shaft end 13 and connected to pistons 21–23; a pair of spaced-apart parallel guide members 27 and 28 supported by housing 11 in parallel relation to shaft 12 and adjacent swash plate 26, see FIGS. 1, 5 and 6; and a pair of rollers 31 and 32 supported on swash plate 26, each on an axis extending radially thereto, one roller 31 being mounted to engage guide member 27 and the other roller 32 being mounted to engage guide member 28 so as to support swash plate 26 against rotational forces imposed thereon and for confining movement of the swash plate axially of cylinders 16–18 for driving pistons 21–23. As a feature of the present invention, spring means 33, FIGS. 5 and 6, are connected to guide member 28, urging it constantly towards roller 32, thereby maintaining smooth, quiet and continuous engagement of the rollers and guide members. As will be observed from FIGS. 5 and 6, spring means 33 functions to constantly take up slack as it may be present in manufacturing tolerances or as may occur with wear. In prior art devices, when slack is present or develops, reverses in torque on the swash plate will cause pounding and wear and considerable noise. With reference to FIGS. 1, 4, 5 and 6, it will be noted that guide member 27 is secured directly to and extends longitudinally from one end 34 of housing 11 to rigidly support the guide structure. Guide member 28 is here carried for movement to and from guide member 27 on a pair of guide and supporting pins 36 and 37, which may be bolts fastened, as by nuts 38, to guide member 27 to project perpendicularly therefrom and which are threaded through aligned openings provided in guide member 28. Guide member 28 may be retained at one end by the head 39 of bolt 37, see FIG. 6, and spring means 33 may comprise a helical spring mounted on bolt 36 between guide member 28 and head 41 on bolt 36. Rollers 31 and 32 may be mounted on a common shaft 42, here composed of a bolt threaded into the peripheral section 43 of wobble plate 26. Where rollers 31 and 32 are mounted on a common shaft, as here shown, guide members 27 and 28 will be offset radially, see FIG. 5, so as to properly engage the rollers. It may be noted, however, that the rollers do not need be axially aligned. Guide member 27 may be provided with a replaceable wear plate 44, as here shown.

Figure 2:
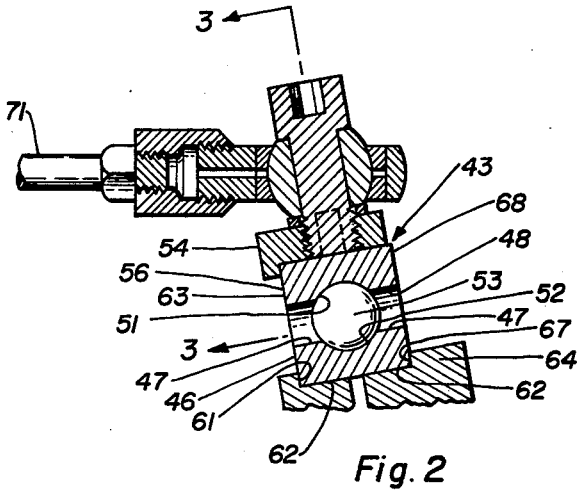
FIG. 2 is a fragmentary cross-sectional view on an enlarged scale of a portion of the device illustrated in FIG. 1.
Figure 3:
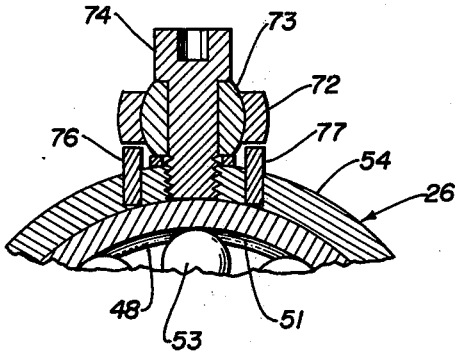
FIG. 3 is a fragmentary cross-sectional view taken substantially on the plane of line 3—3 of FIG. 2.

As a feature of the present structure, swash plate 26 is composed of a hub 46 secured to shaft end 13 for rotation therewith and having an external cylindrical wall 47, see FIG. 2; a peripheral section 43 having an internal cylindrical wall 48 surrounding hub wall 47; walls 47 and 48 being formed with opposed annular recesses 51 and 52 positioned in a plane canted to the axis of the shaft, as seen in FIG. 1; and ball bearings 53 mounted in recesses 51 and 52 and retaining the hub 46 and peripheral section 43 for relative rotation, see also FIGS. 2 and 3. Preferably, and as here shown, hub 46 comprises the inner race of a conventional deep-groove ball bearing; and the peripheral section 43 comprises a ring 54 surrounding and secured to the outer race 56 of a conventional single deep-groove ball bearing. An advantage of this structure is that it locates the ball bearing near the outer diameter of the wobble plate and uses a large conventional ball bearing structure which inherently will have a rating more than sufficient to support the load imposed on it by pistons 21–23. The normal orientation of the bearing would be a thrust bearing, as shown in U.S. Pat. No. 3,663,122. Normally, a ball bearing supports a radial load. An unusual loading is present in the present structure due to the twisting load. It has been found, however, that a conventional single deep-groove ball bearing may be used and, because of its size, will have adequate strength and life expectancy. This type of bearing also has the advantage in that it is entirely self-supporting, that is, the two bearing races are held together in a unitary package which makes assembly of the structure easier. This type of bearing is commercially made in mass production with attendant lower cost. No additional means is required for holding the ball bearings in place, as is common in the case of a thrust bearing.

Another feature of the present structure is the simple and effective means for securing the swash plate hub in its canted position to the shaft and which here comprises a shoulder 57 on the shaft, see FIG. 1; a clamp member 58 mounted on shaft end 13 against shoulder 57 and having a canted surface 59 perpendicular to the plane of the swash plate and a shoulder 61, see FIG. 2, engaged respectively with and supporting an internal surface 62 of the hub and one radially extending side 63 thereof; a second clamp member 64 mounted on shaft end 13 and having a canted surface 66 perpendicular to the plane of the hub and a shoulder 67 engaged respectively with and supporting the internal surface 62 of the hub and opposed radially extending side 68 thereof; and means 69 mounted on shaft end 13 and engaging clamp member 64 and clamping member 64 and 58 against the opposite sides of hub 46 and shaft shoulder 57. In the construction as described, all of the precision machining is accomplished on a single part which is subsequently cut in half to form the two clamping members, the part being bored to receive shaft end 13 and machined to provide the canted surfaces 59 and 66 on a common cylindrical diameter having an axis perpendicular to the plane of the swash plate. The inner race of the conventional ball bearing, forming the hub of the swash plate, will have a cylindrical internal surface 62, which then may be carried directly upon the precisely machined canted surface of the part from which the clamp members are formed. Upon cutting the part in half, as above described, the two clamp sections thus formed may be simply mounted on shaft end 13, as illustrated in FIG. 1, to provide a firm and precise mounting of the swash plate. Clamping means 69 may be simply composed of a nut threaded onto outer shaft end 13. Preferably, the clamping members are keyed to the shaft to prevent relative rotation.

As another feature of the present construction, the several pistons are connected to the swash plate by connecting rods 71 having a conventional ball and socket end connector, that is, with the socket 72 secured as an end extension of one end of rod 71 and the ball joint 73 carried thereby connected to ring 54 at the outer periphery of the swash plate, see FIGS. 1–3, the ball section 73 having a bolt 74 therethrough threaded into ring 54. This structure permits the use of a standard rod end ball and socket joint widely commercially available. In this construction, the standard socket surrounds the ball in a circumferential plane which provides an optimum connection bearing surface and strength of connection in a most simple fashion. In previous structures, the ball is normally provided on a connecting rod with a suitable socket arrangement on the wobble plate.

Another feature of the connecting rod attachment to the wobble plate is the provision of means, see pins 76 and 77, on ring 54 and engageable with socket 72 for limiting its relative displacement on ball 73 in the plane of the swash plate, see FIG. 3. Pins 76 and 77 here project outwardly from ring 54 as studs on opposite sides of the ball joint so as to engage the underside of socket 72. Preferably, members 76 and 77 are formed of plastic or other soft lubricating material.

The present structure enables the use of narrow pistons 21–23, that is, having a minimum depth, and advantage may be taken of this feature in simplifying the connection of the connecting rods 71 to the pistons. In the present construction, the rod ends may be solidly connected to the pistons as by axially threading the rod end 81 into the piston, as seen in FIG. 1. Due to the narrow or shallow depth of the piston, the small wobble motion produced by such solid connection is tolerable. Such structure obviates the need for a lubricated joint between the connecting rods and the pistons. As will also be observed from FIG. 1 and as a further feature of the present structure, the wobble plate and rod end connections thereto run freely in the open and are not required to be enclosed in an oil bath or crankcase. Cooling may be simply accomplished by mounting a fan blade on the shaft and enclosing the compressor within a shroud 83 forming an air passage surrounding the swash plate and housing 11, which may be finned, as seen in FIG. 4, to increase the cooling surface. Lubrication of the rod end ball joints is conveniently accomplished by a standard grease fitting provided on the rod ends. Accordingly, the present structure is particularly designed to pump air or gas without oil contamination, a problem which is virtually unsolvable with a conventional crankcase lubricated compressor, where inevitably blowby of oil vapor will pass into the gas being compressed.

As another and important feature of the present construction, housing 11 is formed with an axial bore 86 centrally of and substantially contiguous with the several pistons; and bore 86 may be fitted with a pair of bearings 87 and 88 for supporting shaft 12, with shaft end 13 being freely cantilevered externally of the bearings for connection to the swash plate. A compact, rigid structure of minimum size and weight results, and because of the general concentric configuration of the unit, the structure may be scaled up more readily to larger sizes than prior art swash plate compressors. Preferably, bearings 87 and 88 are conventional deep-groove ball bearings, which simplify the design and yet afford required strength and bearing capacity.

The use of the roller restraining means, FIGS. 5 and 6, in cooperation with the other structure hereinabove described, provides nearly perfect static balance. Weights 91 and 92 are, preferably, mounted on the opposite ends of shafts 12 to eliminate dynamic imbalance. The result is a compressor which operates very smoothly and with minimum vibration.

In the unit herein disclosed, three cylinders 16–18 are used and connected in series to provide a three-stage compressor. Air is compressed in first stage (cylinder 17), then passes through valves and passageways (not shown) into second-stage cylinder 18 for further compression and delivery into the third stage (cylinder 16) for final compression. In the case of a compressor, conventional self-actuating valves, see valve 93 in FIG. 1, may be used in the cylinder heads to open and close in response to applied pressure differentials in carrying out the intake and compression strokes of the pistons 21–23. To operate the unit as a motor, that is, by applying compressed fluid to the cylinders, conventional motor-driven valves would be used.

A feature of the present construction is the ease of assembly and disassembly of the unit. All wearing parts can be replaced or removed for examination much faster than in prior art structures. The pistons, for example, may be removed by removing shroud 83 and a single bolt 74. Previous designs have required removal of cylinder heads, interconnecting piping, etc. The foregoing provides an important advantage in an oil-free compressor, where more frequent replacement of piston rings is usually required.

Preferably, and as here shown, shaft 12 is extended axially from housing 11 at the side thereof opposite swash plate 26 for connection to a pulley and belt drive 96.

What is claimed is:

1. A device comprising:

a housing and a shaft journalled for rotation therein and having an end extending therefrom, said housing having a plurality of cylinders spaced radially from and extending parallel to said shaft and being circumferentially spaced about said shaft;

pistons mounted for reciprocation in said cylinders;

a swash plate journalled for rotation on said shaft end and connected to said pistons;

a pair of spaced apart parallel guide members supported by said housing in parallel relation to said shaft and adjacent said swash plate;

a pair of rollers rotatably supported on said swash plate, each on an axis extending radially thereto, one of said rollers being mounted to engage one of said guide members and the other of said rollers being mounted to engage the other of said guide members so as to support said swash plate against rotational forces imposed thereon and for confining movement of said swash plate axially of said cylinders upon rotation of said shaft for driving said pistons; and resilient means maintaining engagement between at least one of said rollers and guide members and providing continuous engagement of said rollers and guide members.

2. The device of claim 1, said last named means comprising spring means connected to one of said guide members and urging it toward the roller engaged thereby.

3. The device of claim 1, a shaft secured to and extending radially from said swash plate;

said rollers being mounted in longitudinally spaced relation on and for rotation about said last-named shaft; and said guide members being radially offset one from the other in position for engagement with said rollers.

4. A device comprising:

a housing and a shaft journalled for rotation therein and having an end extending therefrom, said housing having a plurality of cylinders spaced radially from and extending parallel to said shaft and being circumferentially spaced about said shaft;

pistons mounted for reciprocation in said cylinders;

a swash plate journalled for rotation on said shaft and comprising:

a hub secured to said shaft end for rotation therewith and having an external cylindrical wall;

a peripheral section surrounding said hub; and bearing means journalling said section for rotation on said hub in a plane canted to the axis of said shaft; means securing said hub to said shaft comprising:

a shoulder on said shaft;

a clamp member mounted on said shaft against said shoulder and having a canted surface perpendicular to said plane and a second shoulder engaged respectively with and supporting an internal surface of said hub and one radially extending side thereof;

a second clamp member mounted on said shaft and having a canted surface perpendicular to said plane and a third shoulder engaged respectively with and supporting an internal surface of said hub and an opposite radially extending side thereof;

means mounted on said shaft and engaging said second clamp member and clamping said clamp members against the opposite sides of said hub and said shaft shoulder; and means connecting said peripheral section to said pistons.

5. The device of claim 4, said hub having a cylindrical internal surface;

said canted surfaces of said clamp members being formed on common cylindrical diameters having a common axis perpendicular to said plane; and said last-named means comprising a member threaded on said shaft.

6. A device comprising:

a housing and a shaft journalled for rotation therein and having an end extending therefrom, said housing having a plurality of cylinders spaced radially from and extending parallel to said shaft and being circumferentially spaced about said shaft;

pistons mounted for reciprocation in said cylinders;

a swash plate journalled for rotation on said shaft end and connected to said pistons and comprising a hub secured to said shaft end for rotation therewith and a peripheral section surrounding said hub and journalled thereon for free relative rotation in a plane canted to the axis of said shaft;

means supporting said peripheral section against rotation and confining its movement axially of said cylinders upon rotation of said shaft;

a plurality of ball joints on said peripheral section, one for each piston;

connecting rods having sockets at one end journalled on said ball joints and secured at their opposite ends to said pistons; and a pair of studs connected to and extending radially from said section at opposite sides of each of said ball joints and dimensioned to engage and limit the relative displacement of said sockets on said ball joints in said plane.

7. The device of claim 6, said studs being of self-lubricating construction.

* * * * *